United States Patent [19]

Higuchi et al.

[11] Patent Number: 4,584,211

[45] Date of Patent: Apr. 22, 1986

[54] CONTINUOUS HOT DIP ALUMINUM COATING METHOD

[75] Inventors: Seizun Higuchi; Kenichi Asakawa; Nobuyoshi Okada, all of Kitakyushu, Japan

[73] Assignee: Nippon Steel Corporation, Tokyo, Japan

[21] Appl. No.: 641,561

[22] Filed: Aug. 16, 1984

[30] Foreign Application Priority Data

Aug. 17, 1983 [JP] Japan ..... 58-150030

[51] Int. Cl.[4] ..... A23E 5/00

[52] U.S. Cl. ..... 427/320; 427/432

[58] Field of Search ..... 427/329, 432, 320

[56] References Cited

U.S. PATENT DOCUMENTS

| | | | |
|---|---|---|---|
| 4,053,663 | 10/1977 | Caldwell | 427/432 |
| 4,441,936 | 3/1984 | Takahashi | 148/12 C |
| 4,466,999 | 8/1984 | Leonard | 427/329 |
| 4,478,892 | 10/1984 | Amberson | 427/320 |

FOREIGN PATENT DOCUMENTS

| | | | |
|---|---|---|---|
| 2069001 | 8/1981 | United Kingdom | 427/320 |

*Primary Examiner*—Sam Silverberg

*Attorney, Agent, or Firm*—Pollock, Vande Sande & Priddy

[57] ABSTRACT

A continuous hot dip aluminum coating method used in a continuous hot dip aluminum coating line for hot dip aluminum coating on steel in Sendzimir method or non-oxidizing furnace method, said method comprising the covering the surface of the coating bath in the snout of said hot dip coating line by use of an inert gas atmosphere.

7 Claims, 4 Drawing Figures

CONTINUOUS HOT DIP ALUMINUM COATING METHOD

BACKGROUND OF THE INVENTION

The present invention relates to a method of producing a hot dip aluminum coating steel sheet (i.e. hot dip aluminizing steel sheet of high quality.

Hot dip aluminum coating steel sheet generally exhibits a high resistance to heat and, due to this fact, finds various uses such as the material of exhaust pipes of automotive engines, material of heating instruments for household uses, and so forth. In recent years, however, the materials of the exhaust pipes of automotive engines are required to withstand higher temperature. In such uses at high temperature, any coating defect such as imperfect coating, pin hole or the like causes a rapid corrosion of the base iron exposed through such coating defect. For this reason, there is an increasing demand for hot dip aluminum coating steel sheets having no coating defects such as imperfect coating and pin holes. The material of parts used in the exhaust systems of automotive engines is required to have also an excellent oxidation resisting property at high temperature. To this end, it is necessary that the aluminum coating layer is rapidly diffused into the base iron by the heat during the use so as to form an Fe-Al diffused alloy layer having excellent oxidation resisting property, in addition to the elimination of the coating defects mentioned before.

According to the specification of U.S. Pat. No. 2437919, the occurrence of the coating defect such as imperfect coating and pin holes in the actual hot dip aluminum coating process is attributable to the existence of nitrogen, a small amount of oxygen and/or moisture included in gas of reducing atmosphere, which nitrogen, oxygen and moisture form nitrides, oxides and hydrides which a float as scums on the surface of the coating bath in a snout. It is said that the insufficient coating and pin holes are caused by deposition of the scum on the surface of the strip running through the snout.

The following counter-measures have been taken in order to prevent the occurrence of coating defect attributable to the deposition of the scum:

(1) To avoid generation of scum;

(2) To change the nature of the scum such that the scum does not attach to the strip or that the Fe-Al diffusion reaction can be made satisfactorily through the deposited scum; and (3) To mechanically remove the scum from the strip in the molten aluminum bath.

The generation of scums can be avoided by preventing the moisture and oxygen in the reducing atmosphere from coming into the snout. In recent years, it is not so difficult to industrially attain a reducing atmosphere having an $O_2$ concentration of 5 to 6 ppm or lower and a dew point not higher than −40° C., because of the use of nonoxidizing furnace which permits to maintain higher pressure in the furnace. Such low oxygen content and low moisture content appreciably contribute to the prevention of insufficient coating, but this countermeasure solely cannot prevent the occurrence of the coating defect perfectly. Another known method for preventing generation of scums is to dispose a bath of lead or bismuth between the molten aluminum bath and the reducing gas atmosphere in the snout. This method, however, involves a problem in that the heat resisting property and the corrosion resisting property of the hot dip aluminum coating steel sheet are decreased undesirably by the lead and bismuth and, therefore, has not been carried out industrially.

As an example of the second countermeasure which intends to convert the nature of the scum, the specification of the U.S. Pat. No. 2437919 discloses a method in which sodium vapor is introduced into the snout to form powdered sodium aluminate ($AlNaO_2$) on the surface of the coating bath. The sodium aluminate formed on the surface of the coating bath in the snout does not attach to the strip and suppresses the generation of scums which are formed through mutual reaction between the coating bath and the protecting atmosphere. This countermeasure, however, suffers also from the following disadvantage. Namely, the although advantageous effect of addition of the sodium vapor is remarkable when the dew point of the atmosphere is between 30° and −20° C., it is impossible to perfectly prevent the occurrence of coating defects. Further, its effect becomes not appreciable when the dew point is below −40° C. In addition, the sodium vapor introduced into the snout portion considerably deteriorates the coating adhesion of the hot dip aluminum coating steel sheet. This undesirably increases the tendency of separation of the coating layer during a press work which may be conducted subsequently to the coating. Consequently, the hot dip aluminum coating steel sheet cannot withstand the severe condition of press work.

The countermeasure comprising the step of mechanically wiping off the scums from the strip while the strip is in the aluminum bath is quite effective in eliminating the coating defect, but suffers a problem in that scratches caused in the surface of the strip while the latter is in the aluminum bath remain in the coated product to degrade the appearance of the coated product. Such scratches also tend to allow separation of the coated layer when the coated structure is worked by, for example, a press. This method, therefore, has not been successfully carried out in an industrial scale.

The resistance of the aluminum-coated steel sheet to high temperature exceeding 700° C. is largely affected by the components of the steel used as the base sheet to be coated. For instance, in case of a rimmed steel or aluminum-killed steel, the base iron is liable to be oxidized because of cracking in the alloy layer caused during coating or skin-passing. Consequently, the oxidation resistance of the product of such steels is impaired seriously. To avoid this problem, Japanese Patent Publication No. 15454/1978, which claims a convention priority on U.S. Pat. No. 205569, proposes a steel in which Ti content is 4 to 10 times as large as the C content. The current demand for the excellent heat resisting property, however, cannot be met even by this method.

In recent years, in addition to the oxidation resisting property at high temperature above 700° C., there are also demand for superior high-temperature strength and fatigue strength. These requirements are met by adding to the steel some alloying elements which generally serve to impede the hot dip aluminum coating to degrade the quality of the product.

SUMMARY OF THE INVENTION

Accordingly, an object of the invention is to provide a continuous hot dip aluminum coating method (i.e., a continuous hot dip Al coating method) improved to eliminate the occurrence of coating defect such as imperfect coating, pin holes and so forth to thereby ensure high oxidation resistance and high strength.

The bad influences of the oxygen and moisture on the hot-dip aluminum coating has been known empirically, but the unfavourable effect of hydrogen on the hot dip aluminum coating was discovered for the first time by the present inventors. FIG. 1 shows the result of measurement of wettability of steel sheets under various hydrogen concentrations of the atmosphere covering the aluminum bath. It will be seen that the wettability is generally good when the hydrogen content of the atmosphere is not greater than 1000 ppm but is gradually decreased when the hydrogen content exceeds 1000 ppm. It is not possible to obtain substantial wettability in the atmosphere having a large hydrogen content exceeding 2000 ppm. This may be attributed to the fact that the scum formed on the surface of the molten aluminum bath adheres to the steel sheet surface to impede the wetting of the steel sheet.

The present invention was accomplished upon recognition of this fact that the wettability of the steel sheet, i.e., the property of coating, is adversely affected by the hydrogen in the atmosphere under which the hot dip coating is conducted.

More specifically, in a continuous hot dip aluminum coating method which is conducted by a continuous hot dip coating apparatus according to Sendzimir method or nonoxidizing furnace method, the feature of the present invention resides in the matter that an atmosphere having a hydrogen concentration of not higher than 1000 ppm and an oxygen concentration of not higher than 10 ppm is maintained in the snout during hot dip coating thereby preventing occurrence of coating defect such as imperfect coating and pin holes.

By carrying out this method while using the material disclosed in the specifications of U.S. Pat. Nos. 3522110 and 4441936 and Japanese Patent Laid-Open No. 67827/1981, it is possible to produce hot dip aluminum coating steel sheets having an excellent heat resisting property and high-temperature strength.

In addition to the improvement in both the oxidation resistance and heat resistance, the method of the invention offers an advantage in that the product can have a uniform thickness of the coating layer and a superior appearance, owing to the high wettability which effectively eliminates unfavourable conditions such as droop marks, adhesion of dross and so on. When an aluminum-coated sheet having a non-uniform thickness of coating layer is worked by, for example, a press, the exfoliation or separation of aluminum layer tends to be initiated particularly in the portion having an excessive amount of aluminum coating. This problem, however, is perfectly overcome by the present invention which assures a uniform thickness of the aluminum coating layer over the entire surface thereof.

The invention will be fully understood from the following description of the preferred embodiment when the same is read in conjunction with the accompanying drawings.

DESCRIPTION OF THE PREFERRED EMBODIMENTS

Figure 1:
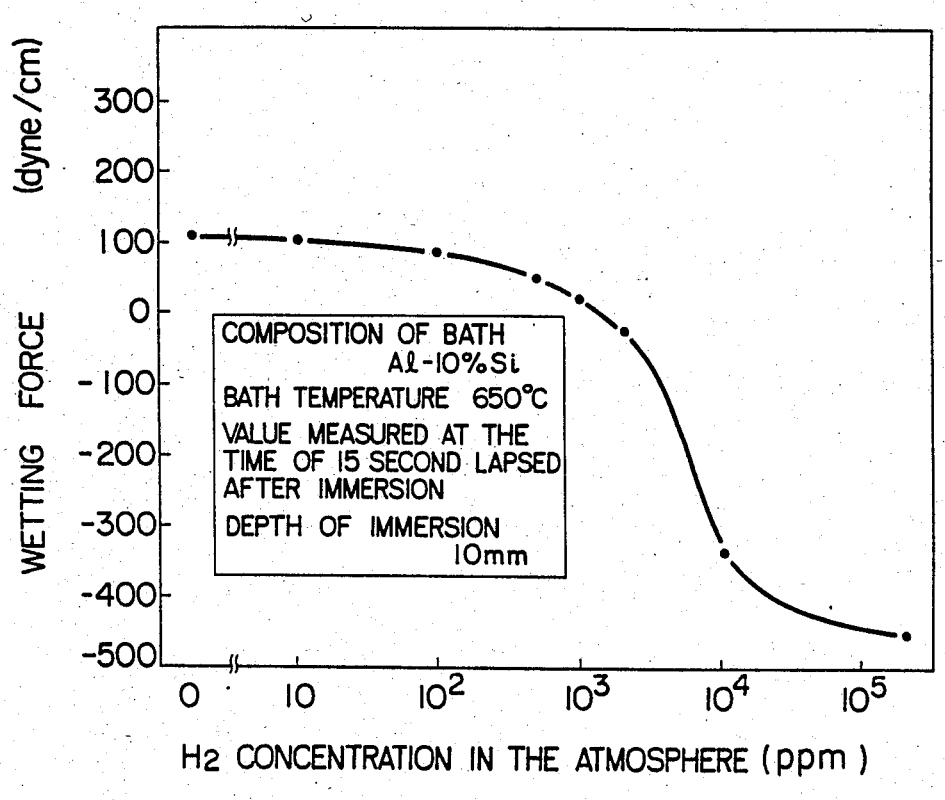
FIG. 1 is a graph showing the result of an experiment which was conducted to examine the relationship between the hydrogen concentration of the atmosphere covering the aluminum coating bath when effecting the hot dip coating and the wettability of steel sheet.
Figure 2:
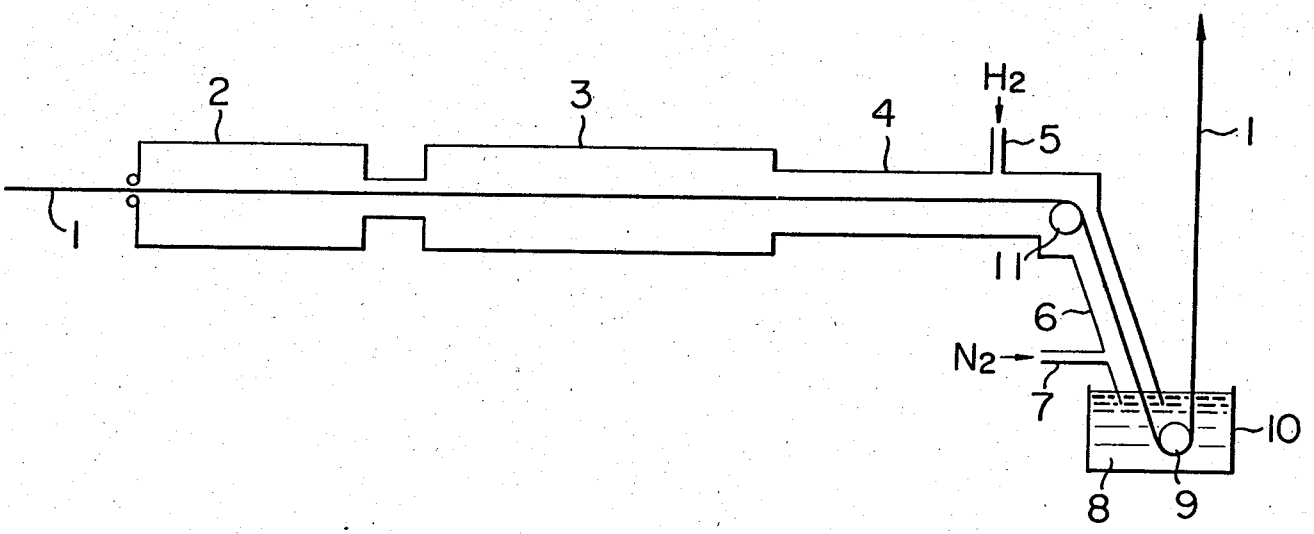
FIG. 2 schematically shows a continuous hot dip aluminum coating line in accordance with nonoxidizing furnace method.

FIG. 2 illustrates an embodiment of the continuous hot dip aluminum coating method embodying the present invention in accordance with Sendzimir process or nonoxidizing furnace method, improved to eliminate the formation of imperfect coating and pin holes.

The material steel sheet 1 to be coated was first fed to a nonoxidizing furnace 2 in which the contaminants on the sheet surface were removed by burning or evaporation, while the steel sheet 1 itself was preheated. The preheated steel sheet was then introduced into a reducing furnace 3 in which a reducing gas atmosphere having hydrogen content of 10 to 20% was maintained, so that the oxidation layer on the surface to be coated was reduced while the steel sheet itself was annealed. The annealed steel sheet 1 was then fed to a cooling furnace 4 in which the temperature of the steel sheet 1 was adjusted optionally for the hot dipping. The steel sheet 1 was then introduced through a snout 6 into an aluminum coating bath 8 without making any contact with air, and was turned upwardly round a pot roll 9. During passing through the coating bath, the steel sheet 1 was hot-dipped with the aluminum. The steel sheet coming out of the coating bath 8 was then coiled after a coating thickness adjustment and cooling.

Figure 3:
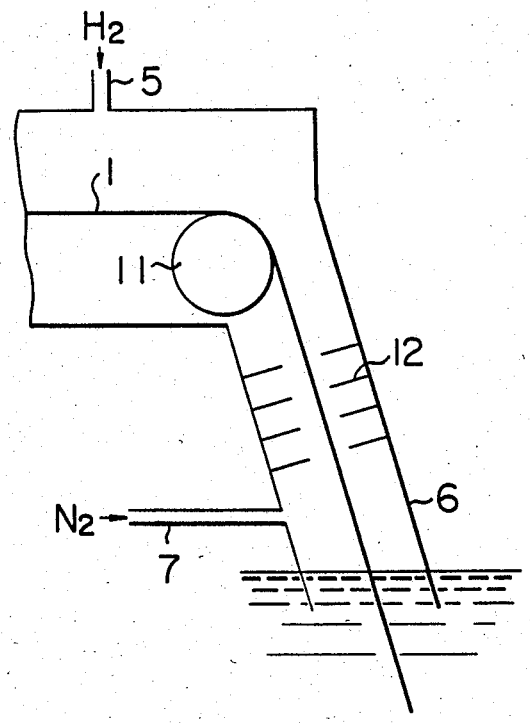
FIG. 3 is an illustration of a labyrinth sealing mechanism which prevents $H_2$ gas from coming into a snout of the continuous aluminum hot-dipping line.
Figure 4:
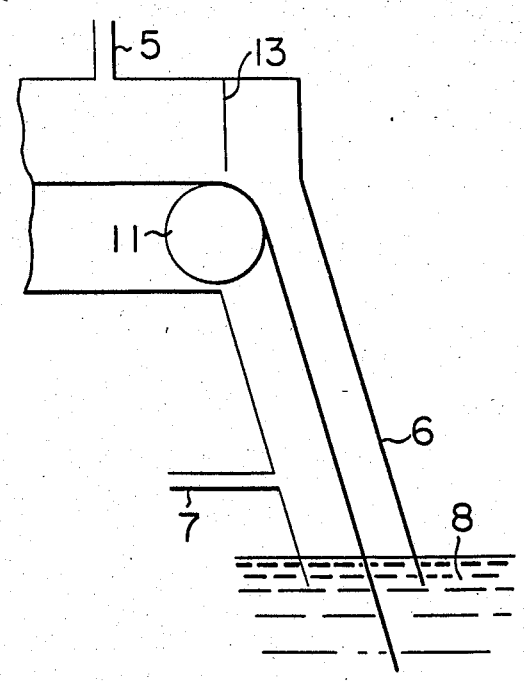
FIG. 4 is an illustration of another sealing mechanism comprising a sealing plate provided around a turndown roll.

According to the invention, a reducing gas inlet 5 is sufficiently spaced apart from the coating bath surface so as to avoid any contact of the reducing gas with the surface of the coating bath, while an inert gas inlet port 7 is provided in the vicinity of the coating bath surface. Consequently, the coating bath in the snout is wholly covered by the inert gas so that the wettability of the base sheet to be coated with the molten aluminum is improved while preventing the adhesion of the scum from being caused, whereby the occurrence of the coating defect such as imperfect coating, pin holes and so forth can be prevented. As a measure for preventing the reducing gas from coming into contact with the surface of the coating bath, it is quite effective to dispose a labyrinth seal as shown in FIG. 3 between the inert gas inlet port 7 and the reducing gas inlet port 5 or to provide a suitable sealing mechanism 13, as shown in FIG. 4 around the turn-down roll 11.

The present inventors have found through various studies and experiments that regarding the atmosphere in the snout an $O_2$ concentration is preferably not higher than 10 ppm, dew point being preferably not higher than $-30°$ C. and hydrogen concentration is preferably not higher than 1000 ppm, for effectively preventing the occurrence of the coating defect.

From an economical point of view, nitrogen is used preferably as the inert gas which is charged into the snout, although other inert gas can be used with equivalent results.

Despite that the structural feature is rather simple, the invention provides remarkable advantages over the conventional hot dip coating: namely, much higher oxidation resisting and heat resisting properties of the hot dip aluminum coating steel sheet can be obtained.

The invention can be most suitably applied to the coating of steel sheet having a very low carbon and Ti-added steel. In such an application, it is possible to produce hot dip aluminum coating steel free of coating defect such as imperfect coating and having quite excellent heat-resisting property as compared with the conventional hot dip aluminum coating steel sheet.

Practical examples of the invention are shown below:

EXAMPLE 1

A cold-rolled steel strip of 0.8 mm thick and 1000 mm wide were hot-dipped in a continuous hot dip aluminum coating line of the type shown in FIG. 2 and having the sealing means as shown in FIG. 3, after the reducing and annealing operations. During the hot-dip coating, there were supplied within the snout 6 the mixture gases of both $N_2$ gas and the decomposition gas of $NH_3$ (75 vol% of $H_2$ and 25 vol% of $N_2$) at a rate of 100 $Nm^3$/hour while varying $H_2$ concentration therein into 0, 50, 100, 500, 1000, 1500, 2000 and 10000 ppm. At the upstream side of a turn-down roll there were supplied $N_2$ gas at a rate of 150 $Nm^3$/hour and the decomposition gas (75 vol% $H_2$, 25 vol% $N_2$) at a rate of 80 $Nm^3$/hour to keep the $H_2$ concentration of 18% in a reducing gas atmosphere with the reducing and annealing of the steel sheet being effected therein at a maximum sheet temperature of 800° C.

As a comparison example, hot dip coating was conducted by supplying both the decomposition gases of $NH_3$ and $N_2$ gas at the rates of 40 $Nm^3$/hour and 125 $Nm^3$/hour within the snout while supplying the decomposition gases of $NH_3$ and $N_2$ gas at the rates of 40 $Nm^3$/hour and 125 $Nm^3$/hour, respectively, at the upstream side portion from the turn-down roll. As another comparison example, the method disclosed in the specification of U.S. Pat. No. 2437919, relying upon the sodium vapor injection was carried out. More specifically, while maintaining the heating temperature in the Na evaporator at 600° C., $N_2$ gas was charged as the carrier gas at the rate of 50 $Nm^3$/hour through the snout, while charging both the decomposition gases of $NH_3$ and $N_2$ gas at the rates of 80 $Nm^3$/hour and 200 $Nm^3$/hour, respectively, at the upstream side from the turn-down roll.

In all cases, the hot dip coating was conducted while maintaining a snout atmosphere containing 0.5 ppm of $O_2$ and having a dewing point of −40° to −45° C. The results of the hot dip coating are shown in Table 1 below. From this Table, it will be seen that the method in accordance with the invention is superior in all aspects of prevention of coating defect, coating appearance (elimination of dross deposition) and coating adhesion.

TABLE 1

| | | performance of Al-coated product | | | |
|---|---|---|---|---|---|
| | atmosphere in snout | imperfect coating | dross deposition | coating adhesion | heat resistance |
| invention | $H_2$: O | piece/$dm^2$ 0 | ○ | ○ | ◎ |
| | 50 ppm | 0 | ○ | ○ | ◎ |
| | 100 ppm | 0 | ○ | ○ | ◎ |
| | 500 ppm | 0 | ○ | ○ | ◎ |
| | 1000 ppm | 0 | ○ | ○ | ◎ |
| | 1500 ppm | 2 | ○ | ○ | Δ |
| | 2000 ppm | 4 | Δ | ○ | x |
| | 10000 ppm | 5 | Δ | ○ | x |
| comparison example (1) | sodium vapor | 4 | Δ | x | x |
| comparison example (2) | $H_2$: 18% | 5 | Δ | ○ | x |

Note:

Imperfect coating: Number of spots of base iron revealed after removal of coating layer by 30% NaOH solution at 80° C.

Dross attaching: by visual check, ○ means almost no dross, Δ dross less than 4/$m^2$, and x heavy dross deposition Coating adhesion: Check for separation of coating layer, using blank of 50 mm in diameter with punch of 33 mm in dia. and deep drawing depth of 10 mm
○ means no coating separation, Δ means occurrence of cracking and x means the occurrence of the separation of coating layer.

Heat resistance: Check of appearance after 5 cycles of heating (700° C., 48 hr) and cooling
◎means good, ∘ slight scale spots, Δ rather many scale spots and x means heavy scale spots or exfoliation of coating layer Compositions of base sheet to be coated (wt%) were 0.05% of C, 0.02% of Si, 0.25% of Mn, 0.016% of P, 0.012% of S, 0.03% of Al and 0.003% of N.

EXAMPLE 2

An investigation was made to find out an alloy composition having excellent oxidation resistance at high temperature, on the basis of a very low carbon and Ti-added steel described in U.S. Pat. No. 3522110 of the same applicant. The hot dip coating was conducted on a steel sheet of 0.8 mm thick and 914 mm wide, by means of a hot dip coating line of the type shown in FIG. 2 provided with a sealing means as shown in FIG. 4. During the hot dip coating, $N_2$ gas solely was supplied within the snout at a rate of 100 $Nm^3$/H, while supplying both the decomposition gases of $NH_3$ and the $N_2$ gas at the upstream side from the turn-down roll at rates of 80 $Nm^3$/H and 150 $Nm^3$/H, respectively. The steel sheet was first reduced and annealed in the reducing furnace at the maximum sheet temperature of 800° C. and was cooled in a cooling furnace down to 680° C. The steel sheet was then dipped in an Al-10% Si coating bath of 650° C. and made to run through this bath at a line speed of 80 m/min. During the hot dip coating, an atmosphere containing 0.5 ppm of $O_2$ and 30 ppm of $H_2$ and having a dew point of −40° C. was maintained in the snout. The results are shown in Table 2 below, from which it will be understood that excellent property of coating and heat-resisting property can be obtained when the steel structure contains 0.08% to 0.25% of Ti and has a Ti/C+N ratio of 15 to 100.

TABLE 2

| Kind of steel | | Steel composition (%) C | Si | Mn | P | S | Sol Al | N | Ti | Ti/C + N | property of hot dip coating | heat resistance 700° C. | 750° C. | 800° C. |
|---|---|---|---|---|---|---|---|---|---|---|---|---|---|---|
| Al-killed steel | | 0.04 | 0.01 | 0.25 | 0.012 | 0.012 | 0.040 | 0.0030 | — | — | ◎ | x | x | x |
| Ti-added steel | 1 | 0.0035 | 0.01 | 0.20 | 0.009 | 0.010 | 0.025 | 0.0019 | 0.025 | 4.63 | ◎ | Δ | x | x |
| | 2 | 0.0030 | 0.01 | 0.19 | 0.008 | 0.010 | 0.024 | 0.0025 | 0.065 | 11.81 | ◎ | ○ | Δ | Δ |
| | 3 | 0.0025 | 0.01 | 0.23 | 0.008 | 0.011 | 0.024 | 0.0027 | 0.080 | 15.38 | ◎ | ◎ | ○ | ○ |
| | 4 | 0.0028 | 0.01 | 0.20 | 0.009 | 0.010 | 0.025 | 0.0020 | 0.132 | 27.50 | ◎ | ◎ | ○ | ○ |
| | 5 | 0.0020 | 0.01 | 0.21 | 0.009 | 0.011 | 0.033 | 0.0018 | 0.205 | 55.40 | ◎ | ◎ | ○ | ○ |
| | 6 | 0.0015 | 0.01 | 0.19 | 0.010 | 0.011 | 0.031 | 0.0011 | 0.250 | 96.15 | ○ | ○ | ○ | ○ |
| | 7 | 0.0020 | 0.01 | 0.18 | 0.011 | 0.010 | 0.030 | 0.0020 | 0.281 | 70.25 | Δ | Δ | ○ | ○ |
| | 8 | 0.0022 | 0.01 | 0.18 | 0.010 | 0.010 | 0.029 | 0.0021 | 0.290 | 67.44 | Δ | Δ | ○ | ○ |
| | 9 | 0.0045 | 0.01 | 0.20 | 0.010 | 0.009 | 0.030 | 0.0021 | 0.215 | 32.58 | ◎ | ◎ | ○ | ○ |
| | 10 | 0.0070 | 0.01 | 0.25 | 0.012 | 0.010 | 0.031 | 0.0025 | 0.213 | 22.42 | ◎ | ◎ | ○ | ○ |
| | 11 | 0.0099 | 0.01 | 0.22 | 0.009 | 0.010 | 0.030 | 0.0022 | 0.210 | 17.36 | ◎ | ◎ | ○ | ○ |
| | 12 | 0.013 | 0.01 | 0.23 | 0.009 | 0.012 | 0.029 | 0.0030 | 0.220 | 13.75 | ○ | Δ | Δ | Δ |
| | 13 | 0.015 | 0.01 | 0.23 | 0.009 | 0.011 | 0.029 | 0.0028 | 0.215 | 12.08 | Δ | Δ | Δ | x |
| | 14 | 0.0025 | 0.01 | 0.25 | 0.010 | 0.009 | 0.025 | 0.0035 | 0.201 | 33.50 | ◎ | ○ | ○ | ○ |
| | 15 | 0.0020 | 0.01 | 0.24 | 0.011 | 0.009 | 0.027 | 0.0040 | 0.215 | 35.83 | ◎ | ○ | ○ | ○ |
| | 16 | 0.0021 | 0.01 | 0.25 | 0.011 | 0.010 | 0.028 | 0.0051 | 0.220 | 30.55 | ○ | x | ○ | ○ |
| | 17 | 0.0028 | 0.01 | 0.25 | 0.012 | 0.010 | 0.028 | 0.0081 | 0.215 | 16.85 | ○ | x | ○ | ○ |

Coating weight of Al layer . . . 80 g/m$^2$ (A) property of hot dip aluminum coating ◎. . . no imperfect coating ○ . . . slight imperfect coating Δ . . . many imperfect coating x . . . extremely many imperfect coating

EXAMPLE 3

An investigation was made to find out alloy composition having excellent high-temperature strength and high-resistance to heat, on the basis of a very low carbon and Ti-added high strength steel comprising Si, Mn and P alloying elements described in U.S. Pat. No. 4441936 of the same inventors. The hot dip coating was conducted on a steel sheet of 0.8 mm thick and 914 mm wide, by means of a hot dip coating line of the type shown in FIG. 2 provided with a sealing means as shown in FIG. 4. During the hot dip coating, $N_2$ gas solely was supplied within the snout at a rate of 150 Nm$^3$/hour, while supplying the decomposition gases of $NH_3$ and the $N_2$ gas at the upstream side from the turndown roll at rates of 80 Nm$^3$/hour and 150 Nm$^3$/hour, respectively. The steel sheet was first reduced and annealed in the reducing furnace at the maximum sheet temperature of 800° C. and was cooled in the cooling furnace down to 680° C. The steel sheet was then dipped in an Al-10% Si coating bath of 650° C. and made to run through this bath at a line speed of 80 m/min. During the hot dip coating, an atmosphere containing 0.5 ppm of $O_2$ and 30 ppm of $H_2$ and having a dew point of −40° C. was maintained in the snout. The results are shown in Table 3 below, from which it will be understood that method of the invention offers excellent property of coating, coating adhesion and heat resistance, and it was confirmed also that excellent normal and high-temperature strengths are obtainable by adjusting the amounts of addition of strengthening elements.

From the results shown in Table 3, below, it will be understood that excellent property can be obtained when the steel structure contains 0.08% to 0.3% Ti and has a Ti/C+N ratio of 4 to 100.

TABLE 3

| composition system | aimed strength Room temp. kg/mm$^2$ | 600° C. kg/mm$^2$ | Performance of hot dip aluminum coating steel sheet test pieces: Steel composition (%) C | Si | Mn | P | S | Al | Ti | N | B | Property of coating | Coating adhesion | Heat resisting property (750° C.) | Strength Room temp. kg/mm$^2$ | 600° C. kg/mm$^2$ |
|---|---|---|---|---|---|---|---|---|---|---|---|---|---|---|---|---|
| Mn—P system | 37 | 15 | 0.003 | 0.10 | 0.8 | 0.06 | 0.010 | 0.05 | 0.16 | 0.003 | — | ◎ | ◎ | ◎ | 37.5 | 16.1 |
| | 37 | 15 | 0.003 | 0.29 | 0.6 | 0.05 | 0.011 | 0.05 | 0.15 | 0.003 | — | ◎ | ◎ | ◎ | 37.2 | 15.7 |
| | 41 | 18 | 0.002 | 0.15 | 1.50 | 0.10 | 0.009 | 0.04 | 0.08 | 0.004 | — | ◎ | ◎ | ◎ | 41.8 | 19.0 |
| | 41 | 18 | 0.003 | 0.09 | 1.45 | 0.09 | 0.008 | 0.03 | 0.15 | 0.003 | — | ◎ | ◎ | ◎ | 41.1 | 18.2 |
| | 44 | 18 | 0.002 | 0.20 | 1.49 | 0.10 | 0.011 | 0.04 | 0.25 | 0.002 | — | ◎ | ◎ | ◎ | 41.8 | 18.9 |
| Mn—P—B system | 37 | 16 | 0.002 | 0.10 | 0.8 | 0.06 | 0.09 | 0.04 | 0.15 | 0.003 | 0.001 | ◎ | ◎ | ◎ | 37.9 | 17.2 |
| | 42 | 19 | 0.003 | 0.12 | 1.50 | 0.10 | 0.010 | 0.05 | 0.15 | 0.004 | 0.002 | ◎ | ◎ | ◎ | 42.5 | 19.5 |

TABLE 3-continued

| composition system | aimed strength Room temp. kg/mm² | aimed strength 600° C. kg/mm² | Steel composition (%) C | Si | Mn | P | S | Al | Ti | N | B | Property of coating | Coating adhesion | Heat resisting property (750° C.) | Strength Room temp. kg/mm² | Strength 600° C. kg/mm² |
|---|---|---|---|---|---|---|---|---|---|---|---|---|---|---|---|---|
| | 43 | 20 | 0.004 | 0.15 | 1.48 | 0.09 | 0.008 | 0.04 | 0.14 | 0.003 | 0.003 | ◎ | ◎ | ◎ | 43.2 | 20.6 |

Performance of hot dip aluminum coating steel sheet test pieces sheet thickness . . . 0.8 mm
coating bath . . . Al-10% Si
coating weight of Al . . . 80 g/m²
Evaluation method:

(A) property of coating (1) no imperfect coating (2) microscopic imperfect coating less than 2/mm × $10^{-2}$ } marked at ◎.

(B) coating adhesion (1) reverse bend test (2) cup deep drawing } no exfoliation marked at ◎.

(C) heat resistance (after 5 cycles of heating in 48 hours and cooling)
(1) coating appearance . . . no abnormality (2) oxidation increment . . . 60 g/m² or less } marked at ◎.

What is claimed is:

1. A continuous hot dip aluminum coating method used in a continuous hot dip aluminum coating for hot dip aluminum coating on steel in Sendzimir method or nonoxidizing furnace method, said steel sheet containing 0.08 to 0.25% of Ti which is 15 to 100 times as large as the total of C and N contents, comprising the step of covering the surface of the coating bath in the snout of said hot dip coating line by use of an inert gas atmosphere, wherein the concentration of hydrogen in said inert gas atmosphere is not more than 1000 ppm.

2. The method of claim 1 wherein the concentration of oxygen in said inert gas atmosphere is not higher than 10 ppm.

3. The method of claim 1 wherein the dew point of the inert gas atmosphere is not higher than −30° C.

4. The method of claim 1 wherein said inert gas comprises nitrogen.

5. The method of claim 2 wherein the dew point of the inert gas atmosphere is not higher than −30° C.

6. The method of claim 5 wherein said inert gas comprises nitrogen.

7. A continuous hot dip aluminum coating method used in a continuous hot dip aluminum coating line for hot dip aluminum coating on steel sheet in Sendzimir method or nonoxidizing furnace method, said steel sheet containing not greater than 0.02% of C, not greater than 0.8% of Si, not greater than 1.5% of Mn, 0.03 to 0.14% of P, not greater than 0.2% of Al and not more than 0.008% of N, and meeting the condition of $4 \leqq Ti/C+N \leqq 100$, comprising the step of covering the surface of the coating bath in the snout of said hot dip coating line by use of an inert gas atmosphere, wherein the concentration of hydrogen in said inert gas atmosphere is not more than 1000 ppm.

* * * * *